US010758793B1

(12) United States Patent
Walsh et al.

(10) Patent No.: US 10,758,793 B1
(45) Date of Patent: Sep. 1, 2020

(54) IRON TYPE GOLF CLUB HEAD

(71) Applicant: Richard H. Walsh, Petaluma, CA (US)

(72) Inventors: Richard H. Walsh, Pentaluma, CA (US); Jeffery D. Sheets, Buda, TX (US)

(73) Assignee: Richard Walsh, Petaluma, CA (US)

( * ) Notice: Subject to any disclaimer, the term of this patent is extended or adjusted under 35 U.S.C. 154(b) by 0 days.

(21) Appl. No.: 16/450,487

(22) Filed: Jun. 24, 2019

(51) Int. Cl.
*A63B 53/04* (2015.01)

(52) U.S. Cl.
CPC .... *A63B 53/047* (2013.01); *A63B 2053/0408* (2013.01); *A63B 2053/0433* (2013.01); *A63B 2053/0479* (2013.01)

(58) Field of Classification Search
CPC ..... A63B 53/047; A63B 2053/0479
USPC ..... 473/324–350
See application file for complete search history.

(56) References Cited

U.S. PATENT DOCUMENTS 4,512,577 A * 4/1985 Solheim ..... A63B 53/04 473/290
4,883,274 A * 11/1989 Hsien ..... A63B 53/04 473/335
4,900,028 A * 2/1990 Antonious ..... A63B 53/04 473/242
5,312,105 A * 5/1994 Cleveland ..... A63B 53/00 473/350
6,565,451 B1 * 5/2003 Lovett ..... A63B 53/04 473/314
6,569,031 B2 * 5/2003 Toyota ..... A63B 53/02 473/290
7,371,189 B2 * 5/2008 Yamamoto ..... A63B 53/047 473/330
8,795,102 B2 * 8/2014 Knight ..... A63B 53/047 473/350

* cited by examiner

*Primary Examiner* — Alvin A Hunter

(57) ABSTRACT

A golf club head including a ball striking face, heel, toe, top ridge, and an arcuate bottom sole having a greater ground contact area located adjacent a central portion of a leading edge of the club head that diminishes in size in a heel to toe direction toward a trailing edge of the club head. The club head is further defined by a leading edge being configured with a radius no greater than 50 mm approximately midway between the heel and toe to enable the golf club head to enter and penetrate the supporting turf during the execution of a golf shot.

9 Claims, 5 Drawing Sheets

IRON TYPE GOLF CLUB HEAD

BACKGROUND OF THE INVENTION

The present invention relates to an iron type golf club and in particular to a golf iron having an improved club striking face, leading edge and sole configuration.

Typically, iron type golf clubs have a shape that includes a high toe apex on a topline that slants downward toward the hosel. The face configuration of these irons includes a relatively flat or slightly curved leading edge configuration between the club face and bottom sole that engages the turf a golf ball lies on during the execution of a golf shot. These clubs normally extend the leading edge from a point adjacent the heel all the way across the face to a second point adjacent the toe of the club. With this configuration, if the angle of approach of the club head is not square or aligned with the turf either the toe portion of the leading edge or the heel portion of the leading edge will strike the turf first causing the club face to turn or twist either opening or closing the face resulting in the golf ball being directed off the target line selected by the golfer.

While almost all irons incorporate these similar characteristics, the short comings of the negative traits are greater enhanced in the wedges due to the higher lofts. The dimension of an iron, or wedge, as measured from the heel side of the hosel to the furthest point away at the toe is called the "blade length". Historically shorter blade lengths have dominated in the past whereas contemporary irons and wedges with higher moments of inertia (MOI) and greater forgiveness on off-center impacts have longer blade lengths.

As blade lengths become longer more material is used in the sole of the clubs as measured from heel to toe. This increased sole dimension creates more mass that makes contact with the turf. With increased turf contact, it is critical that the lie angle of the club be perfectly fit to the golfer, otherwise the heel or toe portion of the sole will make initial contact with the ground causing the face to rotate open or closed and sending the golf ball on an untended directional path.

Side hill lies for traditional irons are another challenge because it is common that either the heel or toe side of the sole will first contact and dig into the ground. It follows that the longer the blade length the more enhanced the heel or toe digging will become as the side hill lies increase in steepness.

Deep rough for traditional irons is another challenging area where both the lower heel and toe portions of the face and sole experience increased resistance from the turf. Here also, the longer the blade length the greater the turf resistance.

Traditional iron or wedge type golf clubs incorporate the greatest amount of mass low on the club head, towards the sole whereby the face is largest and widest just above the leading edge of the club head. Variations of this conventional design in the prior art include iron configurations having a generally rounded leading edge but which have a large radius and with a mass concentration at the bottom of the club head.

SUMMARY OF THE INVENTION

The present invention is a departure from the conventional iron or wedge face and sole profiles. The improved face profile greatly reduces the lower face and sole material providing less resistance and greater relief when the clubhead contacts the turf whether hitting through sand, deep rough, side hill lies, from a divot or from a flat fairway.

Minimizing turf resistance is achieved by shifting the face mass upwards without sacrificing the overall blade length measurement. The club head of this invention has an oversize face area, not only based on blade length, but also based on surface area of the entire face. Yet it greatly reduces turf resistance due to a compact leading edge and steeply angled heel and toe structures of the face.

Further turf resistance relief is achieved through an arcuate shaped sole design. The front edge of the sole is compact near the face. The frontal part of the sole tapers in a progressively flowing arc toward the heel and toe merging with the trailing edge at the rear of the sole thereby getting wider as it progresses towards the trailing edge. This geometry eliminates much of the material found at the heel and toe areas the sole of traditional iron and wedge soles, thereby reducing turf resistance when the club head strikes the ground. This is accomplished by using a leading edge radius at the center of the clubface that is no greater than 50 mm and may be somewhat less to insure minimum turf resistance at the forward portion of the club face.

Although the sole configuration is different from conventional clubs, bounce is designed into the arcuate shaped sole and works similarly to a traditional sole. The trailing edge, which is straighter from heel to toe than the curved shape leading edge, engages the turf with the bounce angle. Because there is so little material on the front edge of the sole, as compared to traditional soles, the club head cuts through the grass or sand with less effort creating a more efficient design than conventional soles.

Structurally, the iron and wedge type golf club heads of the present invention have a face loft of preferably at least 20 degrees, and may have as much as 64 degrees of loft. The club head includes a forward ball striking face with conventional grooves that extend from the top to the bottom of the face. The club head has a top edge or ridge, a bottom sole and heel and toe sides. The club head further preferably includes a hosel for connection to a conventional golf shaft and upper handle or grip. In a preferred embodiment, when viewed from a front elevational perspective, the striking face can be described as having an inverted triangular or trapezoidal shape with rounded corners. This structure provides a larger than conventional striking face with an upper portion of the club face above a midline, in a heel to toe direction, being larger than the bottom of the face adjacent the leading edge adjacent the bottom sole. The heel and toe edges of the face are rounded to fit with the overall design shape of the face and are positioned at an angle of approximately 60 degrees upwardly and outwardly from the lower portions of the striking face toward the upper portions of the face.

The club head is a perimeter weighted, heel-toe balanced oversized club head structure with a higher center of gravity providing increased golf ball back spin when struck with the club head.

The rear of the club head is a conventional design and the rear surface of the club head is formed with a horseshoe, or U-shaped peripheral weight that creates a rear cavity to increase the Moment of Inertia particularly should a golf ball be struck away from the center of percussion of the club head that ultimately relocates the center of percussion higher on the club face.

The sole of the clubhead is arcuate in shape with a minimum of the sole adjacent the leading edge and with a much greater mass toward the sole's trailing edge. The center of the sole is formed with a radius no greater than 28 mm. The heel side of the sole has a radius of no more than 79 mm whereas the toe side of the sole has a radius of no more than 77 mm. This allows the club head to produce a cutting and dispersing action as it engages the turf similar to a snowplow that allows the club face to cut through spreading apart dense vegetation or other material where the golf ball lies. The reduced arcuate structure of front of the club head at the leading edge provides lesser resistance as the club head enters the turf whereas the greater mass at the trailing edge enables the sole bounce to prevent downward digging into the turf, particularly when the club is used in sand or deep grass.

The top ridge or top edge of the club head is formed with a curved surface having a radius between 110 mm and 120 mm. The heel side and the toe side of the striking face are also curved and preferably are formed with a radius of approximately 70 mm. The leading edge at the bottom of the striking face between the club face and the bottom sole is formed with a radius no greater than 50 mm. This radius provides a relatively smaller leading edge and the center of the face in a direction between the heel and toe of the club head that reduces contact with the ground and/or turf during a golf shot.

The overall shape of the club head and in particular the smaller radius of the bottom leading edge and mass of the club head at the lower portion of the club head allows the club face to cut through the ground or turf surface under the golf ball rather than dragging the face through the surface as occurs with many conventional club head designs. This structure also positions the center of gravity, CG, higher on the face allowing greater control by the golfer for a wide variety of different golf shots, particularly those around and near the putting green.

Another feature of the club head relates to alignment. The relatively straight top ridge of the club head as well as the sharply rounded leading edge aid a golfer to position the club head perpendicular to an intended target line thereby instilling confidence in the golfer prior to the execution of a golf shot by visually aligning the center of the leading edge to the intended target line.

Among the objects is the provision of a golf club head that provides less resistance from the ground or turf during the execution of a golf shot.

Still another object is the provision of a golf club with less of the arcuate shaped sole actually contacting the ground or turf during the shot thereby resisting twisting caused by off-center impacts on the face and stabilizing the club head path through impact.

Another object is the provision of a golf club head that provides the appearance of a larger sweet spot for striking a golf ball.

Still another object is the provision of a golf club head having a leading edge design that permits the club head to be used with a variety of different golf ball lies including high grass, rough, sand, a divot, tight lies and various uneven stance conditions that may be encountered by a golfer.

A further object is the provision of a club head shape that facilitates alignment with a golf ball and an intended target line.

These and other objects will be apparent with reference to the following detailed specification and accompanying drawings.

DESCRIPTION OF A PREFERRED EMBODIMENT

Figure 1:
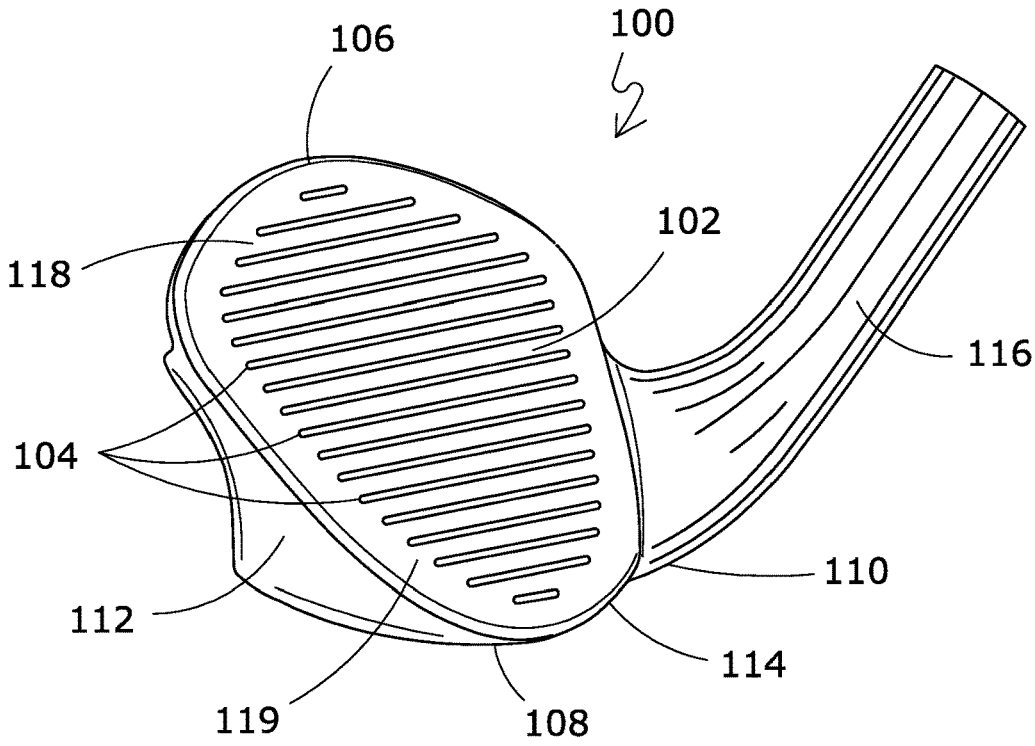
FIG. 1 is a front perspective view of a golf club head in accordance with the present invention.
Figure 2:
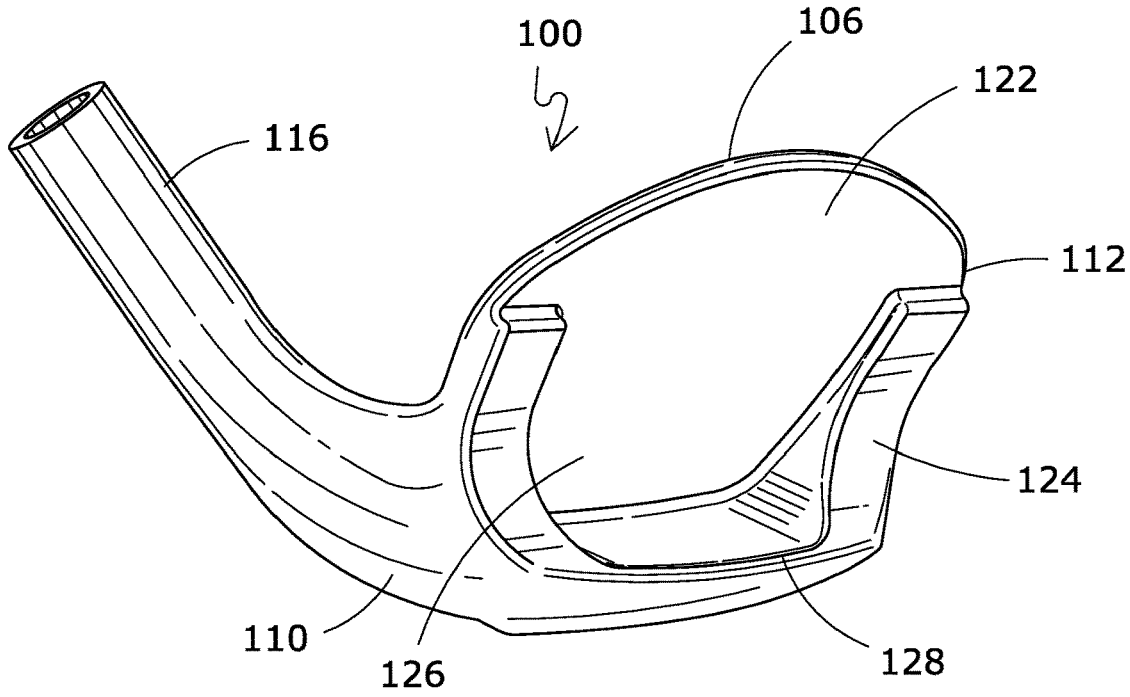
FIG. 2 is a rear perspective of the golf club head of FIG. 1.
Figure 3:
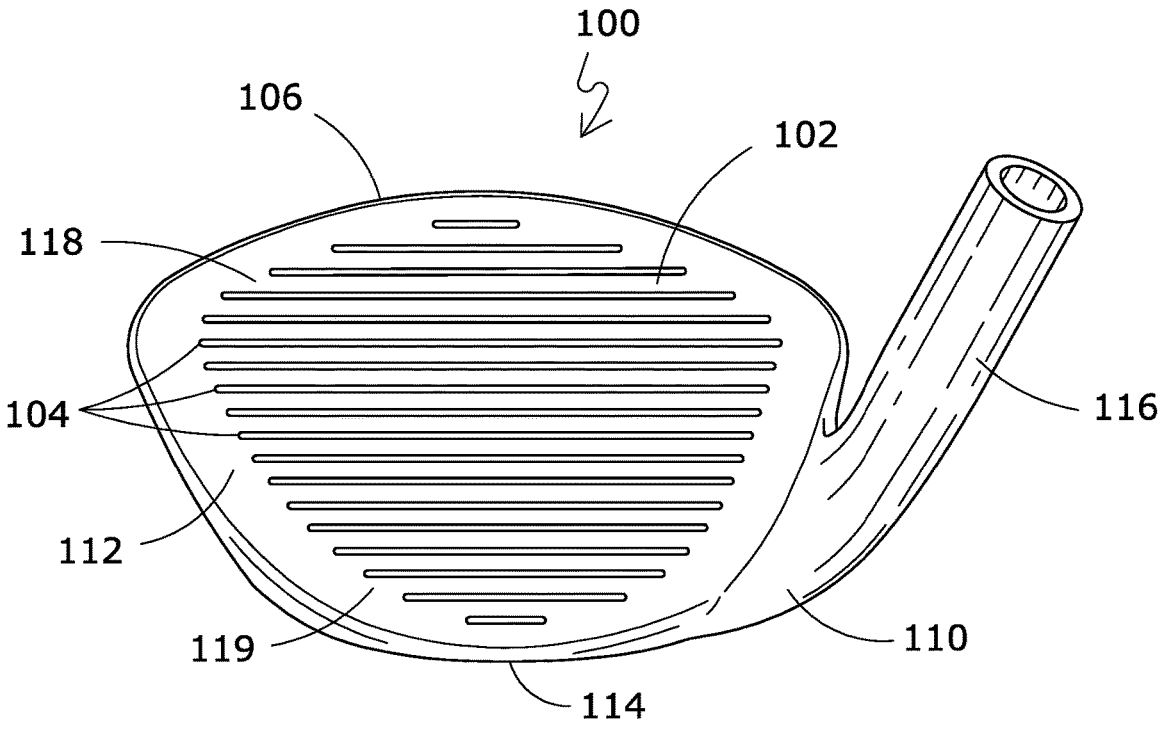
FIG. 3 is a front elevational view thereof.
Figure 4:
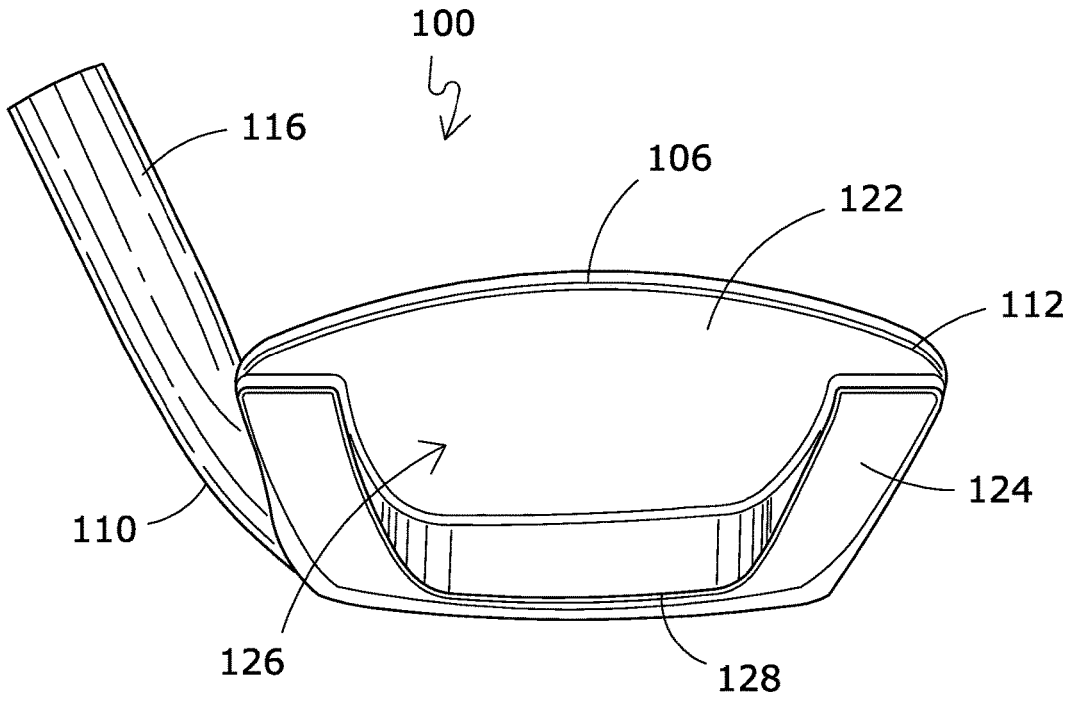
FIG. 4 is rear elevational view.
Figure 5:
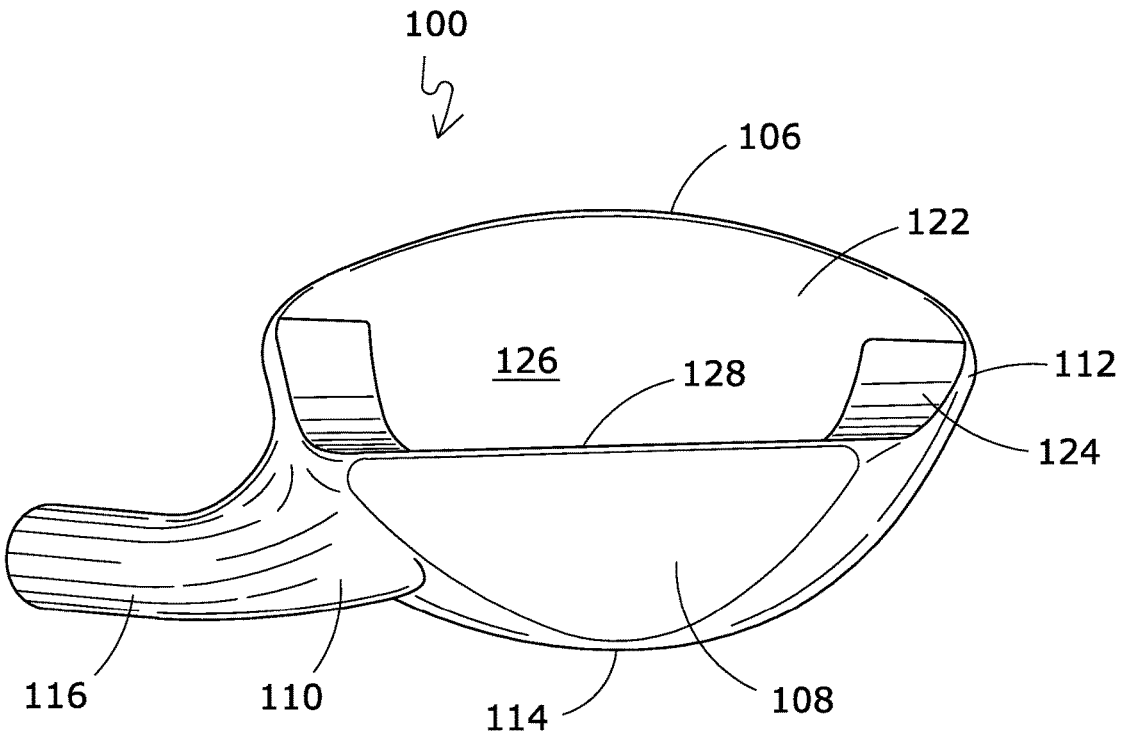
FIG. 5 is a bottom sole view.
Figure 6:
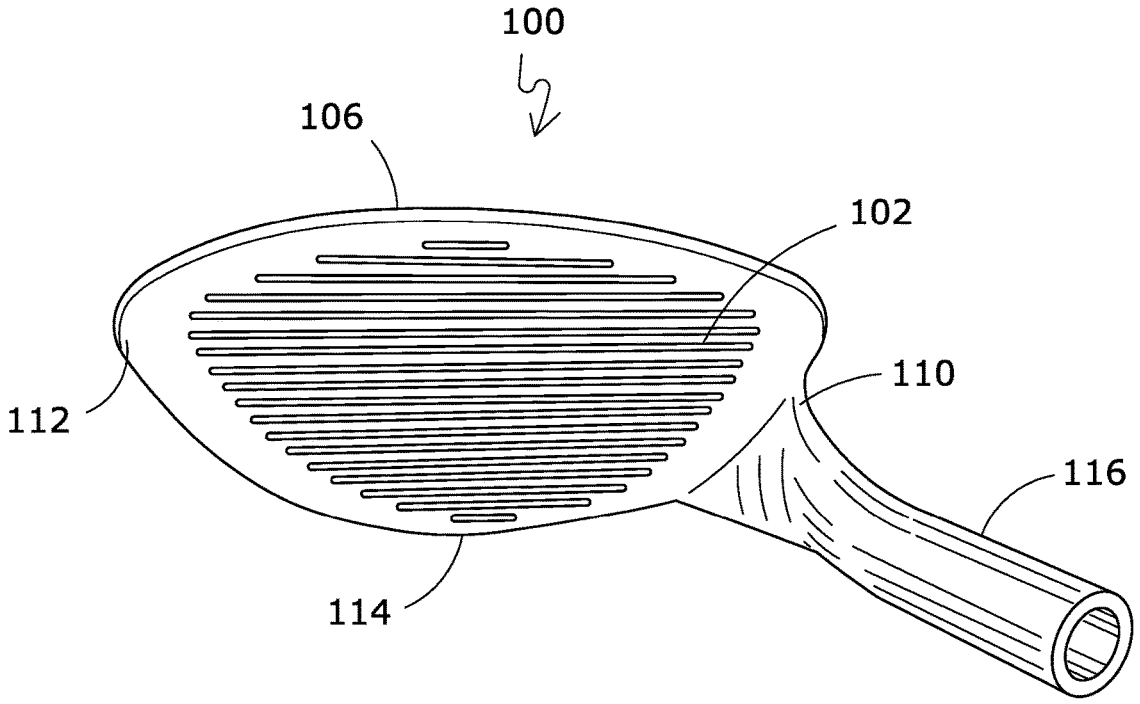
FIG. 6 is a top plan view.
Figure 7:
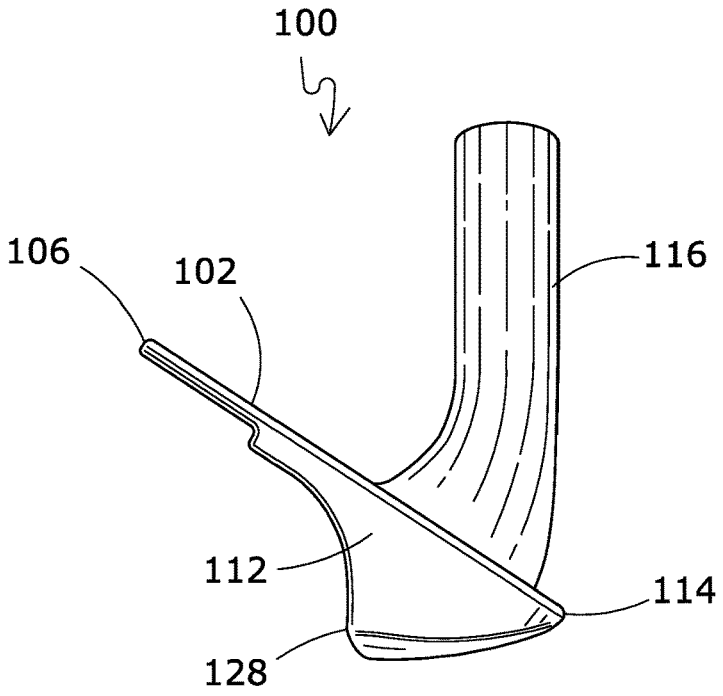
FIG. 7 is a toe side elevational view.
Figure 8:
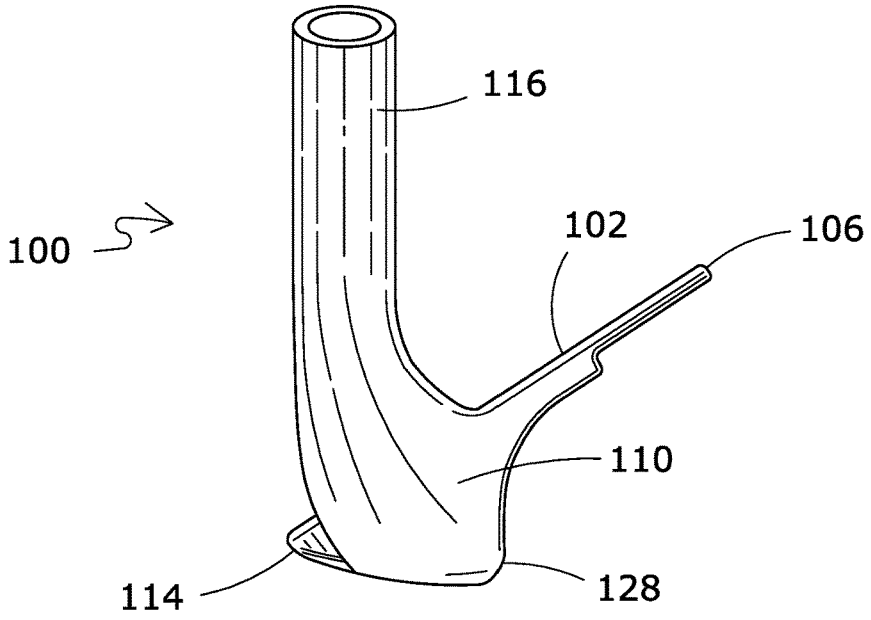
FIG. 8 is a heel side elevational view.
Figure 9:
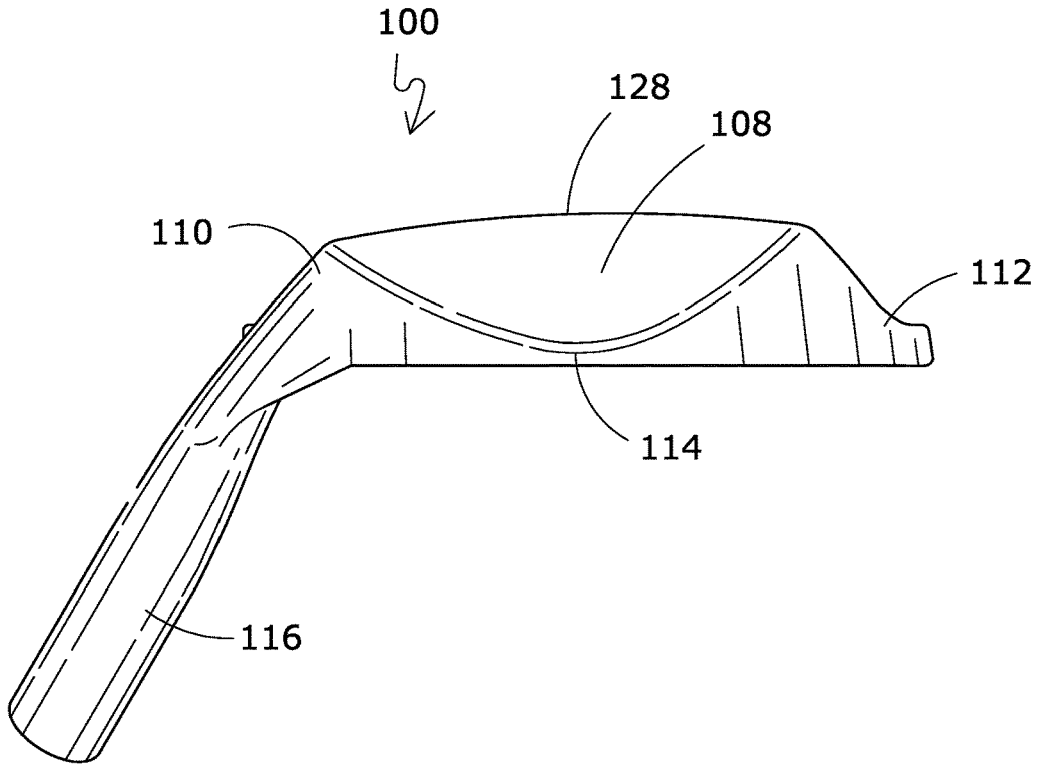
FIG. 9 is a bottom view as seen along the club face.
Figure 10:
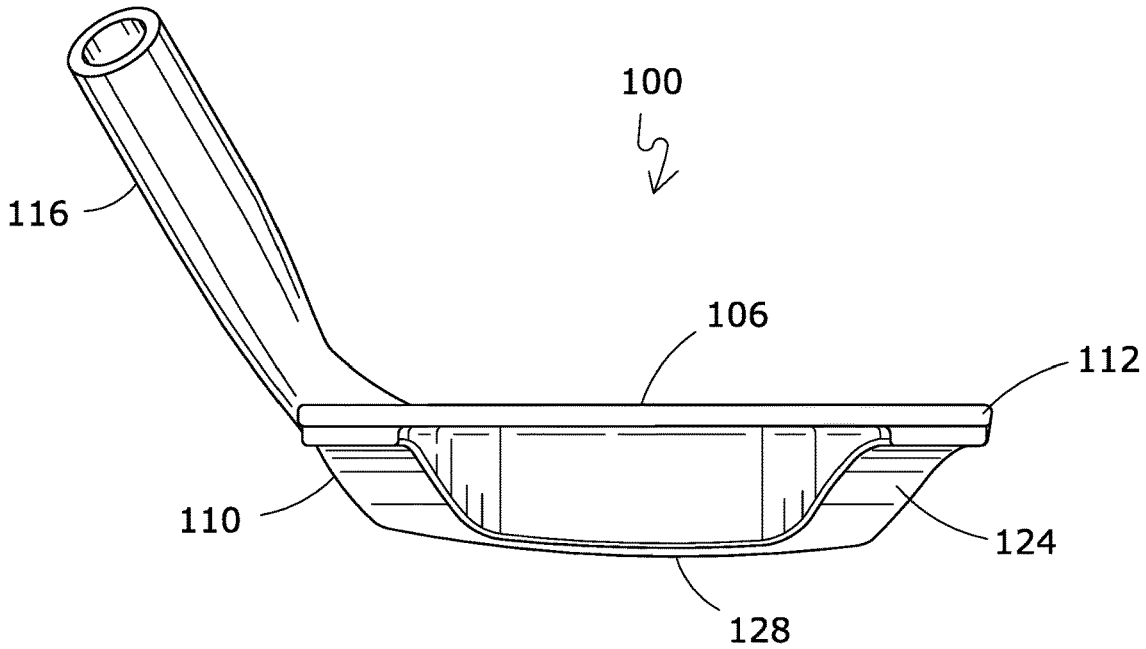
FIG. 10 is a top view as seen along the club face.

Referring to the drawings, a wedge type iron golf club head 100 is shown having a striking 102 face with a loft at least 48 degrees and conventional grooves 104. The club head 100 has a top edge or ridge 106, a bottom sole 108, a heel side 110 and toe side 112. A leading edge 114 forms an interface between the club face 102 and the bottom sole 108. The club head 100 further includes a hosel 116 for connection to a conventional golf shaft and upper handle or grip, not shown. The striking face 102 is formed in an inverted trapezoidal shape with rounded corner surfaces when viewed in a front elevational perspective. The trapezoidal shaped face 102 includes the top ridge 105 that forms a larger and wider upper trapezoidal base, whereas the leading edge 114 forms a lower, more narrow base of the trapezoidal shape. The outer edge 111 of the heel side 110 and the outer edge 113 of the toe side 112 interconnect the upper base and lower base of the trapezoidal shape. See FIG. 3.

An upper portion 118 of the club face 102 is larger and has more surface area adjacent the top ridge 106 than a lower portion 120 of the face 102 in the area adjacent the leading edge 114 between the face 102 and bottom sole 108. The outer edge 111 of the heel 110 and the outer edge 113 of the toe 112 are rounded to fit with the overall design symmetry and shape of the face 102 and are positioned at an angle of approximately 60 degrees between the upper portion 118 and lower portion 120 of the striking face 102.

The rear 122 of the club head 100 is formed with a U-shaped peripheral weight 124 that creates a rear cavity 126 and increases the Moment of Inertia of the club head 100 in the event a golf ball is struck away from the center of percussion of the club head 100.

The top ridge 106 or top edge of the club head 100 is formed as a curved surface having a radius between 110 mm and 120 mm. The outer edge 111 of the heel 110 and the outer edge 113 of the toe 112 of the striking face 102 are also curved and preferably are formed with a radius of approximately 70 mm. The leading edge 114, at the bottom of the striking face 102 approximately midway between the heel 110 and toe 112 is formed with a radius no greater than 50 mm. This radius creates a relatively narrow, arcuate shape to the leading edge 114 between the heel 110 and toe 112 of the club head 100 that reduces contact with the ground and/or turf during the execution of a golf shot.

The bottom sole 108 of the club head 100 includes a forward portion 128 that is arcuate in shape and curves rearwardly toward the heel 110 and toe 112 and a rearward portion 130 that is approximately linear and forms a trailing edge 132. The sole 108 is the widest in a front to rear direction at an approximate center of the leading edge 114 of the face 102 and presents a greater amount of ground contact surface at that point. As the forward portion 128 of the sole 108 curves rearwardly away from the center toward the heel 110 and toe 112, the sole 108 becomes progressively narrower in a front to rear and heel to toe direction until the forward portion 128 of the sole 108 ultimately intersects with the trailing edge 132 of the club head 100. It follows there is a progressively lesser ground contact area of the sole 108 away from the center of the club head 100 essentially eliminating the ground contact area of the sole 108 at the heel 110 and toe 112 during the execution of the golf shot.

This structure allows the club head 100 to produce a cutting action as it engages the turf since the minimum structure of the forward portion of the club head 100 at the leading edge 114 as well as the minimum area of the frontal portion 128 of the sole 108 at the center of the club head 100 in a heel 110 to toe 112 direction provides lesser contact surface presented to the turf. In turn, the club head 100 encounters lesser resistance as it enters the turf allowing the club head 100 to cut through the surface of the turf under the golf ball rather than dragging the face across the ground surface as occurs with many conventional club head designs.

Preferably a radius 134 of at least a central area of the frontal portion 130 of the sole 108 at the center of the club head 100 is no greater than 28 mm. As the sole 108 curves rearward toward the heel 110, the radius is no greater than 79 mm whereas as the sole 108 curves toward the toe 112 a radius is no greater than 77 mm. This geometry creates a maximum front to rear dimension of approximately 27 mm at the center of the leading edge 114 of the club head 100 and a trailing edge 132 of approximately 62 mm in a heel 110 to toe 112 direction.

The greater ground contact area of the rear portion 130 of the sole 108 at the trailing edge 132 enables the sole 108 to bounce preventing downward digging into the turf, particularly when the club is used in sand or deep grass.

In addition, the overall shape of the club head 100 positions the center of gravity, CG, higher on the face 102 allowing greater control by the golfer for a wide variety of different golf shots, particularly those around and near the putting surfaces.

It will be appreciated the above described technology for a wedge type golf club is equally applicable for a lesser lofted golf iron head having a loft configuration of as little as 20 degrees or even less and that other modifications may be made to the above described invention in keeping with the spirit and scope of the following claims:

The invention claimed is:

1. A golf club head including a ball striking face, heel, toe, top ridge, bottom sole, a leading edge between said striking face and said bottom sole, and trailing edge at the rear of said bottom sole, wherein the improvement comprises:

said club head being further defined by said leading edge being configured with a radius no greater than 50 mm approximately midway between said heel and said toe;

said ball striking face has a larger surface area in a heel to toe direction at an upper portion of the face adjacent said top ridge and said ball striking face has a smaller surface area than said larger surface area at a lower portion of said face;

and, wherein said ball striking face includes heel side edges and toe side edges each oriented at an angle of approximately 60 degrees relative to an upright orientation and outward orientation of said club head.

2. The golf club head of claim 1 wherein said top ridge has a radius of at least 110 mm.

3. The golf club head of claim 1 wherein said heel side edges and said toe side edges have a radius of at least 70 mm.

4. The golf club head of claim 1 wherein said striking face is configured in a generally inverted trapezoidal shape including an upper base at the top ridge of said striking face, a lower base at said leading edge and sides interconnecting said upper and said lower bases.

5. The golf club head of claim 4 wherein said striking face is rounded at the intersections of said trapezoidal bases and interconnecting sides.

6. A golf club head including a ball striking face, heel, toe, top ridge, bottom sole, a leading edge between said striking face and said bottom sole, and trailing edge at the rear of said bottom sole, wherein the improvement comprises:

said club head being further defined by said leading edge being configured with a radius no greater than 50 mm approximately midway between said heel and said toe;

said leading edge being arcuate in shape between said heel and said toe, and, said trailing edge extends between said heel and said toe in a generally linear configuration.

7. The golf club head of claim 6 wherein said bottom sole includes an arcuate forward portion and is defined by having greater ground contact surface located adjacent a center location of said leading edge in a heel to toe direction and a progressively lesser ground contact surface extending from said center location toward said heel and toward said toe.

8. A golf club head including a ball striking face, heel, toe, top ridge, bottom sole, a leading edge between said striking face and said bottom sole, and trailing edge at the rear of said bottom sole, wherein the improvement comprises:

said club head being further defined by said leading edge being configured with a radius no greater than 50 mm approximately midway between said heel and said toe;

said bottom sole having a front edge; at least a portion of said front edge being formed with a radius of no greater than 27 mm;

said front edge extending rearwardly in a heel to toe direction forming a connection with said trailing edge;

wherein said bottom sole has a maximum dimension between said leading edge and said trailing edge of approximately 27 mm.

9. The golf club of claim 8 wherein said bottom sole has a maximum width of 62 mm in a heel to toe direction.

* * * * *